US008461444B2

(12) United States Patent
Miwa

(10) Patent No.: US 8,461,444 B2
(45) Date of Patent: Jun. 11, 2013

(54) TONE-GENERATION TIMING SYNCHRONIZATION METHOD FOR ONLINE REAL-TIME SESSION USING ELECTRONIC MUSIC DEVICE

(75) Inventor: Akihiro Miwa, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 13/334,736

(22) Filed: Dec. 22, 2011

(65) Prior Publication Data

US 2012/0160080 A1 Jun. 28, 2012

(30) Foreign Application Priority Data

Dec. 28, 2010 (JP) ..... 2010-293529

(51) Int. Cl.
*G10H 7/00* (2006.01)

(52) U.S. Cl.
USPC ..... 84/645

(58) Field of Classification Search
USPC ..... 84/645–647
See application file for complete search history.

(56) References Cited

U.S. PATENT DOCUMENTS

| | | | | |
|---|---|---|---|---|
| 5,530,859 | A * | 6/1996 | Tobias et al. | 713/400 |
| 6,067,566 | A * | 5/2000 | Moline | 709/219 |
| 6,141,324 | A * | 10/2000 | Abbott et al. | 370/236 |
| 7,254,644 | B2 * | 8/2007 | Norimatsu et al. | 709/248 |
| 7,297,858 | B2 * | 11/2007 | Paepcke | 84/609 |
| 7,420,112 | B2 * | 9/2008 | Juszkiewicz et al. | 84/600 |
| 7,970,962 | B2 * | 6/2011 | Chu et al. | 710/34 |
| 2005/0150362 | A1 * | 7/2005 | Uehara | 84/645 |
| 2006/0123976 | A1 * | 6/2006 | Both et al. | 84/600 |
| 2007/0140510 | A1 * | 6/2007 | Redmann | 381/97 |
| 2007/0283799 | A1 * | 12/2007 | Carruthers et al. | 84/645 |
| 2012/0160080 | A1 * | 6/2012 | Miwa | 84/623 |

FOREIGN PATENT DOCUMENTS

JP 4314964 B2 5/2009

OTHER PUBLICATIONS

Iwai et al.; "Tenori-on Manual TNR-W/TNR-O"; Yamaha Corporation.

Apple Computer Incorporated, "Game Center"; Dec. 22, 2011. http://www.apple.com/game-center/.

* cited by examiner

*Primary Examiner* — Jeffrey Donels
(74) *Attorney, Agent, or Firm* — Rossi, Kimms & McDowell LLP

(57) ABSTRACT

An online real-time session is conducted between at least two electronic music devices each equipped with an interface connectible to a communication network and a display with a touch sensing ability. An electronic music device communicates with its counterpart device to count a time Ta1 of making an inquiry about a present time Tb of the counterpart device and a time Ta2 of receiving a response from the counterpart device while setting a time Ta3 which progresses from the time Ta2 and a time interval Td which is counted from the time Ta3. Thus, the electronic music device determines tone-generation timing at which the electronic music device is synchronized with its counterpart device in conducting an online real-time session by way of a calculation of Td+Tb+(Ta3−Ta1)−(Ta2−Ta1)/2, or Td+Tb+(Ta3−Ta2)+(Ta2−Ta1)/2.

2 Claims, 8 Drawing Sheets

TONE-GENERATION TIMING SYNCHRONIZATION METHOD FOR ONLINE REAL-TIME SESSION USING ELECTRONIC MUSIC DEVICE

BACKGROUND OF THE INVENTION

1. Field of the Invention

The present invention relates to a tone-generation timing synchronization method for an online real-time session conducted between electronic music devices via a communication network in a synchronized manner. The present invention also relates to an electronic music device with an interface connectible to a communication network and an ability of conducting an online real-time session with its partner device in synchronism with predetermined tone-generation timings.

The present application claims priority on Japanese Patent Application No. 2010-293529 filed Dec. 28, 2010, the content of which is incorporated herein by reference.

2. Description of the Related Art

Electronic music devices with an ability of conducting online real-time sessions with partner devices have been conventionally known and commercially available worldwide. Non-Patent Document 1 discloses a typical electronic music device with is able to conduct an online real-time session with its partner device. This electronic music device, namely "TENORI-ON", includes performance operators having LEDs that are manually operated to input music information, so that users are able to visually recognize performance operators operated by themselves. Additionally, this electronic music device is able to conduct music performance with its counterpart electronic music device connected thereto via a MIDI cable (where MIDI stands for "Musical Instrument Digital Interface"). In Particular, Non-Patent Document 1 (see pages 7-8) refers to synchronized performance conducted between TENORI-ON instruments according to the MIDI standard in a master-slave manner. Among two electronic music devices connected together via a MIDI cable, one electronic music device serving as a master sends a start command and a MIDI clock signal to the other electronic music device serving as a slave, thus implementing perfectly synchronized performances therebetween.

Apple Computer Incorporated has launched "Game Center" (see Non-Patent Document 2) which is social gaming software providing multiplayer games with an auto-match function for finding game partners around the world. This allows game players to simultaneously perform online games in a synchronized manner but does not necessarily provide online real-time session functionality.

The foregoing electronic music device needs to be directly connected to its counterpart electronic music device via a MIDI cable; hence, it is impossible to conduct synchronized music performance between electronic music devices, located in remote places, which cannot be directly connected via a MIDI cable.

Another system is developed to achieve synchronized performance among a plurality of electronic music devices via a communication network such as the Internet, whereas these electronic music devices need to be synchronized with each other in terms of performance start timings.

Patent Document 1 discloses a performance timing synchronization method in which a master device sends a "ping" command, representing a delay time confirmation signal, to a slave device, and then the slave device sends back its response to the master device, thus calculating a half of a reciprocating time of communication as a communication delay time t1. Herein, a reference time as the performance start timing is set to five seconds counted from the present time, for example, so that the master device sends a performance start signal to the slave device at (5−t1×2) seconds after the present time.

In this method, however, a communication delay time may frequently vary between the time of sending a performance start signal and the time of sending or receiving a "ping" command (which is used for calculating the communication delay time t1). This cause a time deviation between the actual performance start timing and the predetermined performance start timing.

PRIOR ART DOCUMENT

Patent Document 1: Japanese Patent No. 4314964

Non-Patent Document 1: TENORI-ON MANUAL of Yamaha Corporation

Non-Patent Document 2: Apple Computer Incorporated, "Game Center" (http://www.apple.com/game-center/)

SUMMARY OF THE INVENTION

It is an object of the present invention to provide a tone-generation timing synchronization method securing high-precision performance start timing in an online real-time session conducted between electronic music devices.

It is another object of the present invention to provide an electronic music device installing an online real-time session control program that allows users to enjoy an online real-time session with its partner device via a communication network.

A first aspect of the present invention refers to a tone-generation timing synchronization method adapted to a plurality of electronic music devices each including an interface connectible to a communication network. The tone-generation timing synchronization method includes the steps of: making, by a first electronic music device, an inquiry about a present time Tb of a second electronic music device at a time Ta1 which is counted by the first electronic music device; sending back, by the second electronic music device, the present time Tb to the first electronic music device, wherein the present time Tb indicates the time when the second electronic music device receives or responses to the inquiry made by the first electronic music device; measuring, by the first electronic music device, a time Ta2 of receiving the present time Tb of the second music device; setting, by the first electronic music device, a time Ta3 which progresses from the time Ta2; further setting, by the first electronic music device, a time interval Td which is counted from the time Ta3; and determining tone-generation timing, shared between the first electronic music device and the second electronic music device, at which the first electronic music device is synchronized with the second electronic music device in conducting an online real-time session therebetween by way of a calculation of Td+Tb+(Ta3−Ta1)−(Ta2−Ta1)/2, or Td+Tb+(Ta3−Ta2)+(Ta2−Ta1)/2.

A second aspect of the present invention refers to an electronic music device including an interface that establishes a connection with a counterpart electronic music device, and a controller that conducts an online real-time session with the counterpart electronic music device. The controller carries out the foregoing steps of the tone-generation timing synchronization method.

The present invention is characterized by limiting a factor determining the tone-generation timing involving a communication delay to a one-way delay time (Ta2−Ta1)/2 which is the middle time between Ta1 for sending an inquiry about the present time Tb and Ta2 for receiving a response regarding the present time Tb, thus defining the reference time for setting the tone-generation timing as Tb=Ta1+(Ta2−Ta1)/2, which is shared between electronic music devices conducting an online real-time session therebetween. This establishes precise matching of the tone-generation timing between electronic music devices even when a communication delay time for setting the tone-generation timing differs from a communication delay time which occurs when measuring the one-way delay time.

Additionally, the "inviter" electronic music device, which sends an invitation to the "invitee" electronic music device, can arbitrarily set the time Ta3 and the time interval Td for determining the actual tone-generating at Td+Tb+(Ta3−Ta1)−(Ta2−Ta1)/2, or Td+Tb+(Ta3−Ta2)+(Ta2−Ta1)/2. This brings flexibility in synchronizing the tone-generation timing shared between these electronic music devices; hence, the present invention is advantageous in that the tone-generation timing can be accurately and flexibly established between electronic music devices conducting an online real-time session in real time without considering communication delays which may fluctuate due to communication lines over time.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENT

The present invention will be described in further detail by way of examples with reference to the accompanying drawings.

Figure 1:
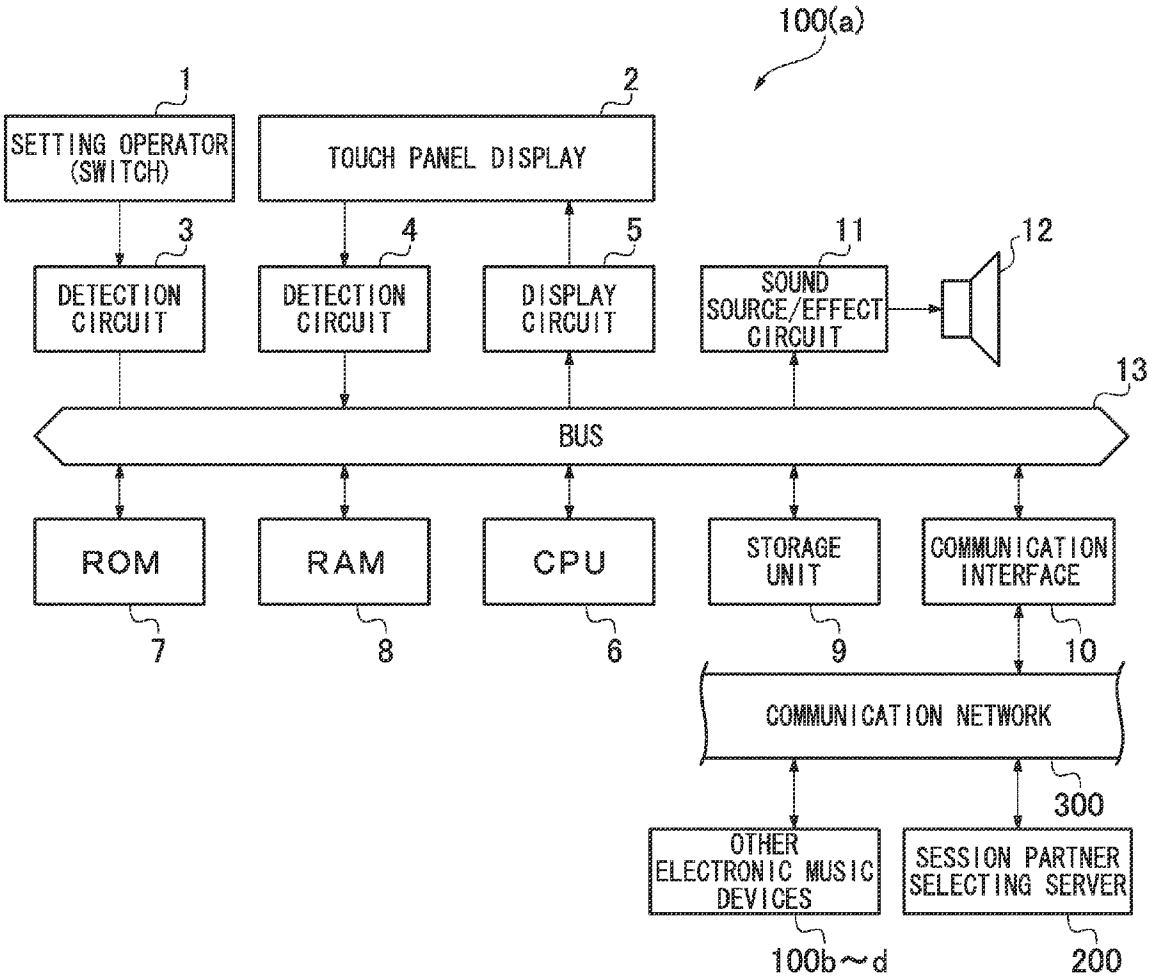
FIG. 1 is a block diagram of an electronic music device according to a preferred embodiment of the present invention.

FIG. 1 is a block diagram of an electronic music device 100 according to a preferred embodiment of the present invention.

The electronic music device 100 (e.g. 100*a*) includes constituent elements 1 through 13. Setting operators 1 are switches for inputting various pieces of information. A touch panel display 2 includes a plurality of performance operators and displays a plurality of operators and various pieces of information, which are controlled by users touching desires ones selected from among various music parameters and various operation modes. When a user touches a desired operator or desired information on the screen, the touch panel display 2 selectively sets its performance state, music parameter, and operation mode. A detection circuit 3 detects the operated states of the setting operators 1. Another detection circuit 4 detects user's touch operations made on the screen of the touch panel display 2. A display circuit 5 displays GUIs (graphical user interfaces) on the screen of the touch panel display 2, wherein GUIs allow users to selectively set various states and information regarding music performance such as performance states, music parameters, and operation modes. A CPU 6 controls and manages the processing of the electronic music device 100. A ROM 7 stores various control programs and table data executed by the CPU 6. A RAM 8 temporarily stores performance information, input information, and calculation results. A storage unit 9 stores various application programs (e.g. control programs), music data, and other data. A communication interface 10 conducts transmission/reception of various data with other electronic music devices 100*b* to 100*d* and/or a session partner selecting server 200 via a communication network 300. A sound source/effect circuit 11 converts performance information into music signals and applies various effects to music signals. There are provided two types of performance information, i.e. input performance information that is input by a user operating performance operators, and reproduced performance information that is reproduced based on music data stored in the storage unit 9. A sound system 12 produces sounds based on music signals from the sound source/effect circuit 11. For instance, the sound system 12 is configured of a digital-to-analog converter (DAC), an amplifier, and a speaker.

All the constituent elements 1 through 11 are connected together via a bus 13; the communication interface 10 is connected to a communication network 300; and the sound source/effect circuit 11 is connected to the sound system 12.

The storage unit 9 is configured of storage media and its driver. As storage media, it is possible to employ a flexible disk (FD), a hard disk (HD), a CD-ROM, a DVD, a magneto-optic disk (MO), and a semiconductor memory. The storage media can be detachably attached to the driver, or the storage unit 9 can be detachably attached to the electronic music device 100. Alternatively, it is possible to firmly incorporate both the storage media and the storage unit 9 so that they cannot be separated from the electronic music device 100. The storage unit 9 (or its storage media) is able to store control programs executed by the CPU 6. In other words, it is possible to store control programs in the storage unit 9 instead of the ROM 7 so that control programs are loaded into the RAM 8. In this case, the CPU 6 executes its processing based on control programs loaded into the RAM 8 in a similar manner that the CPU 6 executes its processing based on control programs preinstalled in the ROM 7. This allows users or manufacturers to easily add new control programs or easily upgrade to latest versions of control programs.

As the communication interface 10, it is possible to name a music-specified wired interface specified for transmission/reception of music signals such as MIDI signals, a general-purpose short-distance wired interface such as USB (Universal Serial Bus) and IEEE1394, a general-purpose network interface such as Ethernet (a registered trademark), and a general-purpose short-distance wireless interface such as a wireless LAN (Local Area Network) and Bluetooth (a registered trademark), and a communication interface applied to a digital telephone network. The present embodiment employs a general-purpose network interface as the communication interface 10 and Ethernet as the communication network 300; hence, the present embodiment is designed to communicate with other electronic music devices 100*b* to 100*d* or the session partner selecting server 200 at remote places.

The present embodiment realizes the functionality of the electronic music device 100 by use of a general-purpose slate PC (equipped with a touch panel) or a smart phone. Of course, the electronic music device 100 may be configured of hardware with a non-touch-panel LCD (Liquid Crystal Display) and physical performance operators having LEDs.

In the present embodiment, the other electronic music devices 100*b* to 100*d* perform the same processing as the electronic music device 100 (e.g. 100*a*); hence, all the electronic music devices 100*a* to 100*d* have the same hardware configuration shown in FIG. 1. For the sake of convenience, the electronic music device 100*a* communicates with three electronic devices 100*b* to 100*d*; however, it is possible to arbitrarily determine the number of electronic music devices connected to the electronic music device 100. Since the present embodiment is characterized in conducting an online real-time session over a network (hereinafter, simply referred to as a net-session), the electronic music device 100 needs to be connected to at least one electronic music device.

The session partner selecting server 200 is a general-purpose computer acting as a server. Specifically, the session partner selecting server 200 can be configured using the electronic music device 100, precluding the setting operators 1, the touch panel display 2, the detection circuits 3, 4, and the display circuit 5 from the hardware configuration of FIG. 1, equipped with a keyboard, a mouse, and a large-size display. The session partner selecting server 200 includes a CPU, a ROM, a RAM, and a storage unit, all of which significantly differ from the CPU 6, the ROM 7, the RAM 8, and the storage unit 9 in terms of their abilities and capacities.

In the present embodiment, the session partner selecting server 200 is designed as a single unit of equipment; but this is not a restriction. It is possible to adopt a decentralized computing structure or a cloud-computing structure.

Figure 2A:
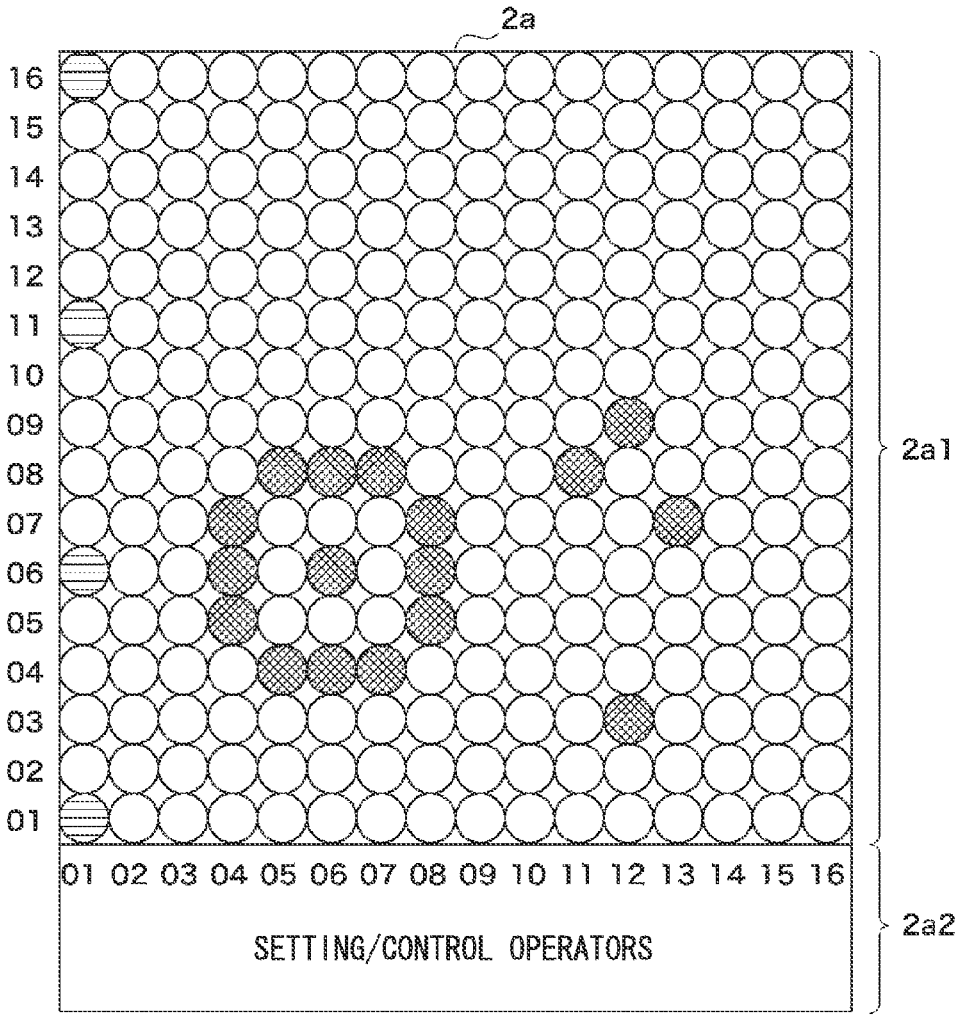
FIG. 2A shows an example of a performance operator screen which is displayed on a touch panel display included in the electronic music device of FIG. 1.

FIG. 2A shows an example of a performance operator screen 2*a* displayed on the screen of the touch panel display 2. The overall area of the performance operator screen 2*a* is divided into a first display area 2*a*1 for displaying a plurality of performance operators/indicators, and a second display area 2*a*2 for displaying a plurality of setting/control operators and the current setting/control condition.

As the performance operators/indicators, the first display area 2*a*1 displays totally 256 circular buttons in a matrix form (consisting of 16×16 columns/rows). Different pitches (specified by numbers "01" to "16") are aligned on the vertical axis (or Y-axis) in ascending/descending order in which larger numbers represent higher pitches, while different times (specified by numbers "01" to "16") are aligned on the horizontal axis (or X-axis) in forward/backward order in which higher numbers represent time progression. In actuality, the numbers "01" to "16" are not shown on the screen of the touch panel display 2 since they are used for simplifying the following description. Additionally, circular buttons resemble physical operators, i.e. LED buttons (which may configure performance operators/indicators); hereinafter, circular buttons are referred to as LED buttons. For instance, each of "01" to "16" on the horizontal axis represents an eighth note so that one screen image may represent two measures of music performance.

The LED buttons can be displayed in different manners using different colors or different brightness. In the illustration of FIG. 2A, different hatching patterns represent different display manners (e.g. different colors).

The electronic music device 100 involves six performance modes (indicating different operations of LED buttons and different types of sound/light emitted from LED buttons), namely a score mode (SCORE), a random mode (RANDOM), a draw mode (DRAW), a bounce mode (BOUNCE), a push mode (PUSH), and a solo mode (SOLO).

(A) Score Mode

The score mode is a basic mode among six performance modes, which allows a user of the electronic music device 100 to designate tone-generation points with LED buttons such a way that notes are written on a score. After completion of setting tone-generation points with LED buttons, the score mode allows a loop indicator to move from the left to the right in a loop manner, thus repeatedly generating sounds corresponding to tone-generation points.

(B) Random Mode

After completion of setting tone-generation points with LED buttons, the random mode allows the electronic music device 100 to repeat sound/light emission in conjunction with tone-generation points of LED buttons.

(C) Draw Mode

The draw mode allows the electronic music device 100 to temporarily store a trace pattern in which a user traces LED buttons on the screen in a certain time period, thus repeating sound/light emission in accordance with the stored trace pattern.

(D) Bounce Mode

The bounce mode allows the touch panel display 2 to sequentially change the position of light emission on the screen such that light emission moves down from the position of an LED button pressed by a user and then reaches the baseline (i.e. the lowermost part of the screen) as if a ball bounces on the ground. Herein, the electronic music device 100 generates sound every time light emission hits the baseline on the screen.

(E) Push Mode

When a user holds an LED button, the push mode allows the electronic music device 100 to generate a circle of light around the position of the pressed LED button such that the circle of light is gradually enlarged on the screen. Additionally, the electronic music device 100 generates sound which is varied in response to a varying size of the circle of light.

(F) Solo Mode

In a time period while a user holds an LED button, the sole mode allows the electronic music device 100 to repeatedly generate the corresponding sound. This sound is stopped when the user releases his/her finger from the LED button.

Next, a setting method for setting tone-generation points, a tone-generation method, and a light emission method will be described in detail with respect to the score mode which is the most basic mode among six performance modes.

When a user gives a short press to the touch panel display 2 (i.e. when the user presses an LED button on the screen for a short time period and then releases his/her finger off the LED button), the electronic music device 100 generates sound having a pitch assigned to the pressed LED button. At the same time, the pressed LED button is placed in a first display manner that allows each LED button to shine in a first color. Additionally, the light of the short-pressed LED button spreads across its surrounding LED buttons as if ripples (or waves) are spreading across the surrounding area, whereas the electronic music device 100 does not necessarily generate sounds of pitches assigned to the surrounding LED buttons causing a light spreading phenomenon on the screen. The first display manner immediately disappears so that the short-pressed LED button turns off its light and returns to its original state.

When a user gives a long press to the touch panel display 2 (i.e. when the user presses an LED button on the screen for a long time period and then releases his/her finger off the LED button), a tone-generation point is set to the pressed LED button, which is thus placed in the first display manner. The tone-generation point setting is released by long-pressing the already long-pressed LED button again, so that the twice long-pressed LED button returns to its original state. The tone-generation point setting can be carried out before starting music performance. The present embodiment allows users to set or release a tone-generation point on each LED button in real time during music performance.

A loop indicator is configured of a plurality of LED buttons, which are placed in a second display manner that allows each LED button to shine in a second color, on the performance operator screen 2*a* shown in FIG. 2A. Specifically, the loop indicator consists of four LED buttons at coordinates (01,01), (01,06), (01,11), and (01,16) (where each coordinates is defined a pair of the horizontal-position number and the vertical-position number). At first, the loop indicator is set to an initial position, i.e. coordinates (01,*) (where * indicates an arbitrary number selected within a range from "01" to "16"; hence, coordinates (01,*) is positioned on the leftmost column in the first display area 2*a*1 of the performance operator screen 2). When automatic performance starts, the loop indicator starts to move rightwards from its initial position in synchronism with a predetermined tempo. When the column including the loop indicator overlaps with an LED button with the tone-generation point setting, the electronic music device 100 generates sounds of a pitch assigned to the LED button. At this time, the LED button may temporarily change its display manner from the first display manner to another display manner (e.g. a display manner that allows each LED button to turn on its light for an instant). When the loop indicator reaches the last column (i.e. the rightmost column) within the rightward reachable range in the first display area 2*a*1 of the performance operator screen 2*a*, the loop indicator immediately returns to its initial position, so that the loop indicator repeats to move from the leftmost column to the rightmost column As a typical example of performance conducted in the score mode, the electronic music device 100 conducts automatic performance as the loop indicator sequentially passes through tone-generation points which are determined in advance or which are designated during automatic performance. The score mode achieves real-time performance by way of real-time short pressing on desired LED buttons in synchronism with automatic performance.

The electronic music device 100 does not necessarily involve six performance modes; hence, the number of performance modes can be arbitrarily determined.

A plurality of setting/control operators and the current setting/control state are displayed in the second display area 2*a*2. As setting/control operators, it is possible to provide an automatic performance start/stop button, a mode change button, a layer change button, a block change button, and other operators for setting tempos, tone colors, octaves, volumes, and gate times, wherein each operator is not necessarily displayed in a button-like shape and can be displayed in a slider shape or a dial shape. All the operators need not be displayed in the second display area 2*a*2, so that the second display area 2*a*2 may selectively display the operators that are necessary in each operation mode.

Figure 2B:
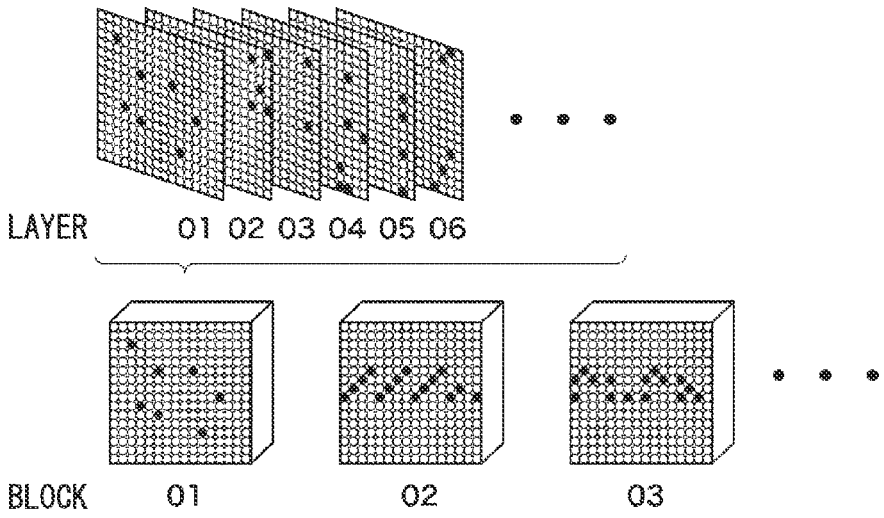
FIG. 2B shows the concept of layers and blocks for use in music performance with the electronic music device.

FIG. 2B shows the concept of layers and blocks for use in music performance with the electronic music device 100. One layer represents one performance sequence, for example, one recording track of a multi-track recorder that can record and reproduce performance data with respect to one or plural performance parts in a musical tune including a plurality of real-time performance parts. One layer corresponds to rendition of 256(=16×16) LED buttons displayed in the first display area 2*a*1 of the performance operator screen 2*a*. The electronic music device 100 is able to carry out automatic performance simultaneously multiplexing a plurality of layers (e.g. sixteen layers), wherein automatic performance may constitute of layers with different tone colors, different tone volumes, and different performance modes, thus rendering music performance with rich variations.

One block is a combination of layers which can be simultaneously performed. Since the electronic music device 100 is able to multiplex maximally sixteen layers, one block may be constituted of maximally sixteen layers. The electronic music device 100 is able to register a plurality of blocks (e.g. sixteen blocks) with the RAM 8, thus rendering music performance with complex progression by sequentially switching over blocks.

Figure 3:
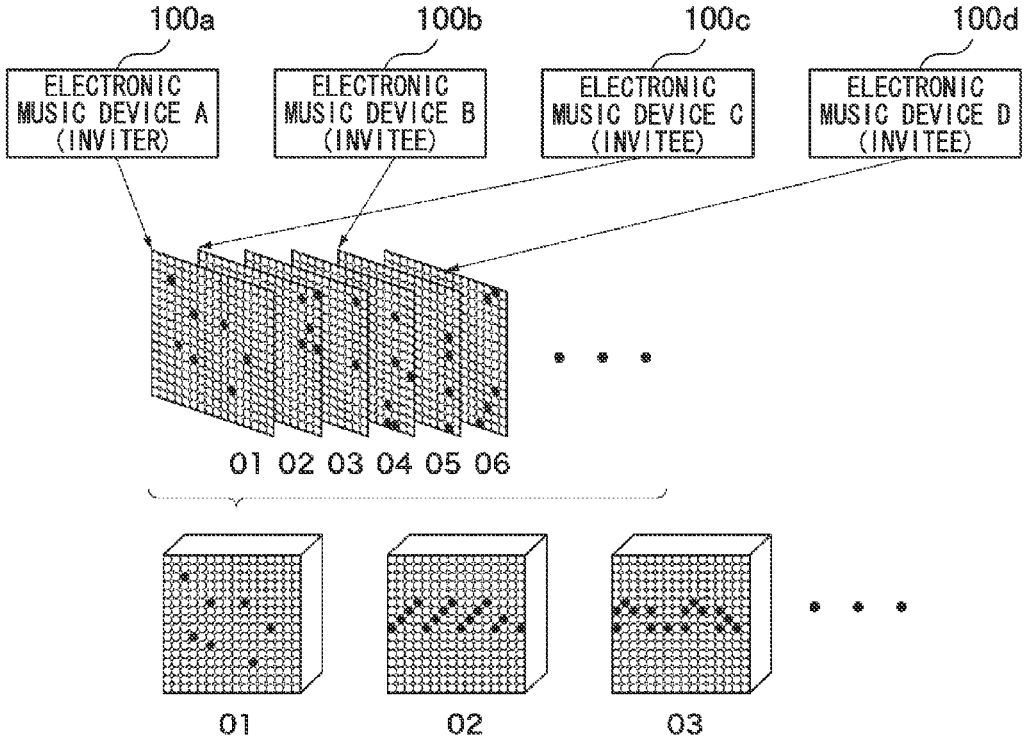
FIG. 3 shows the concept of an online real-time session which is carried out by electronic music devices via a communication network.

Next, a control process executed by the electronic music device 100 will be described in detail. FIG. 3 shows the outline of the control process of the electronic music device 100, and FIGS. 4 to 8 show details of the control process of the electronic music device 100.

Specifically, FIG. 3 shows the concept of a net-session which is carried out by the electronic music devices 100*a* to 100*d* via the communication network 300.

In FIG. 3, the electronic music device 100*a* conducts a net-session with three electronic music devices 100*b* to 100*d* via the communication network 300. There are four participants involved in a net-session, namely electronic music devices A, B, C, D (i.e. the electronic music devices 100*a*, 100*b*, 100*c*, 100*d*), wherein one of four participants acts as an "inviter" while three participants act as "invitees". Herein, an inviter is an electronic music device first to declare its intension to carry out a net-session. In FIG. 3, the electronic music device A (100*a*) acts as an inviter. A user operates the electronic music device A to initiate a net-session with the electronic music devices B-D (100*b*-100*d*).

Each of the electronic music devices A to D is able to selectively perform an arbitrary layer, whereas all the electronic music devices A-D are allowed to share one block in common. FIG. 3 shows that the electronic music device A selects Layer 01; the electronic music device B selects Layer 05; the electronic music device C selects Layer 02; and the electronic music device D selects Layer 06. When an LED is short-pressed on the screen of one electronic music device (e.g. the electronic music device A), its operation information is transmitted in real time (allowing for a slight communication delay) to other electronic music devices (e.g. the electronic music devices B-D), so that other electronic music devices generate the same sound as the sound generated by one electronic music device. When all the electronic music devices A-D select the same layer, they are placed in the same display manner. The electronic music devices A-D are able to change their parameters such as tone volumes, tone colors, currently performed blocks, and tempos, so that instructions for changing these parameters are transmitted from one electronic music device to other electronic music devices; hence, all the electronic music devices can maintain the same performance states after changing these parameters.

The present embodiment is characterized in that the electronic music devices A-D can carry out a net-session without any problem by way of the following processes.

(1) Process of adjusting consistency of tone-generation timing (hereinafter, simply referred to as a "tone-generation timing synchronization process")

(2) Process of eliminating inconsistency of on/off states at tone-generation points (hereinafter, simply referred to as a "tone-generation point synchronization process")

When a user initiates a net-session with the electronic music device A, the electronic music device A transmits a start command to the other electronic music devices B to D, whereby the electronic music device A starts a net-session in conjunction with the electronic music devices B to D. When the electronic music device A sends a start command to the other electronic music devices B-D, a time deviation may occur at the start timing of a net-session, conducted between the electronic music device A and the other electronic music devices B-D, due to a communication delay which occurs until the start command of the electronic music device A actually reaches the other electronic music devices B-D. To cope with this drawback, the present embodiment performs the tone-generation synchronization timing synchronization process (see (1)).

When the users of the electronic music devices A-D simultaneously operate the same LED button to change on/off states of tone-generation points while the electronic music device A-D display LED buttons in the same layer (which is selected by the users of the electronic music devices A-D), the electronic music devices A-D may differ from each other in terms of on/off states of tone-generation points. A concrete example of this situation will be discussed later. To cope with this drawback, the present embodiment performs the tone-generation point synchronization process (see (2)).

Next, details of the control process will be described with reference to FIGS. 4 to 8.

Figure 4:
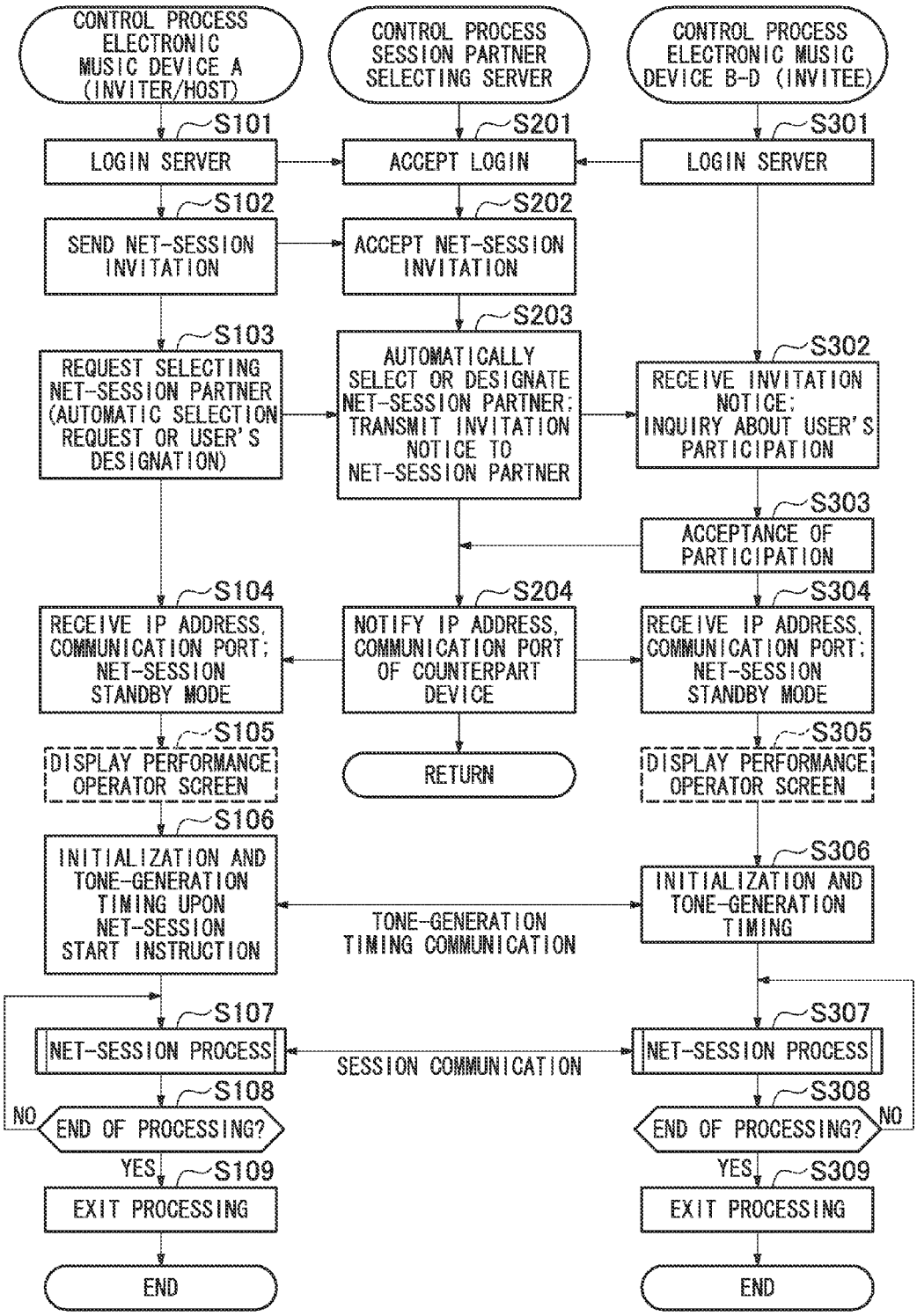
FIG. 4 is a flowchart of a control process executed by electronic music devices and a session partner selecting server.

FIG. 4 is a flowchart of the control process executed by the electronic music device A, the other electronic music devices B-D, and the session partner selecting server 200. In actuality, the control process is executed by the CPUs included in the electronic music device A, the other electronic music devices B-D, and the session partner selecting server 200, whereas the following description does not necessarily refer to CPUs but explains such that the control process is executed by the electronic music devices A-D and the session partner selecting server 200. In FIG. 4, the electronic music device A (100*a*) acts as an "inviter" as well as a "host" computer which leads the tone-generation point synchronization process. Details of processing of a host computer will be discussed later in conjunction with the tone-generation point synchronization process. FIG. 4 shows such that a series of steps involving the control process is connected to one of the other electronic music devices B-D (100*b*-100*d*) because these devices B-D are designed to execute the same processing.

First, a user operates the electronic music device A to display a login screen (not shown) on the touch panel display 2. When the user touches a login button with his/her finger on the login screen, the electronic music device A reads a server name (or an IP address) of the session partner selecting server 200 from the ROM 7 (or the storage unit 9). Based on the read server name, the electronic music device A accesses the session partner selecting server 200 so as to transmit login information to the session partner selecting server 200 (step S101). For instance, the login information includes a login ID (or a login identification) and a login password. Upon receiving the login information, the session partner selecting server 200 performs an authentication process based on the received login information (step S201). Upon completion of the authentication process, the electronic music device A is placed in a login condition with the session partner selecting server 200, so that a login progressing screen (not shown) is displayed on the touch panel display 2.

Next, when the user touches a "net-session invitation" button on the login progressing screen with his/her finger, the electronic music device A sends a net-session invitation (i.e. information representing an invitation to a net-session) to the session partner selecting server 200 (step S102). Upon receiving the net-session invitation (step S202), the session partner selecting server 200 waits for the next instruction issued by the electronic music device A.

When the user touches a "net-session partner select" button with his/her finger on the login progressing screen, the electronic music device A requests the session partner selecting server 200 to select net-session partners (step S103). At this time, the user of the electronic music device A can freely make a decision whether or not to designate net-session partners when requesting the session partner selecting server 200 to appoint net-session partners. When the user has known of the name of a preferable session partner before requesting the session partner selecting server 200, the user can directly designate the session partner in conjunction with the session partner selecting server 200. However, when the user has not known of the name of a preferable session partner, the electronic music device A retrieves a list of names (who can be appointed) from the session partner selecting server 200, allowing the user to select the name of a preferable session partner. The present embodiment allows the user to simply refer to the session partner selecting server 200 in selecting session partners without designating a preferable session partner. In this case, the present embodiment may allow the user to designate the number of session partners as well as the nationality or residence of each session partner. Alternatively, the user may leave his/her selection of session partners to the session partner selecting server 200 without designating preferable conditions.

Upon receiving a selection request from the electronic music device A, the session partner selecting server 200 automatically selects session partners involved in a net-session or already designated session partners. Then, the session partner selecting server 200 transmits an invitation notice to each electronic music device (i.e. one of the electronic music devices B-D) corresponding to each selected session partner (step S203). Herein, the session partner selecting server 200 performs an automatic select procedure on the electronic music devices B-D, each of which is placed in a login condition with the session partner selecting server 200. When the user of the electronic music device A has already designated the number of session partners as well as the nationality and residence of each session partner, the session partner selecting server 200 selects session partners in conformity with designated conditions.

Upon receiving an invitation notice from the session partner selecting server 200, each of the electronic music devices B-D inquires its user about his/her decision whether or not to participate in a net-session (step S302). When the user designates "participate" on the screen of his/her electronic music device (i.e. one of the electronic music devices B-D), the electronic music device sends back "acceptance of participation" to the session partner selecting server (step S303).

Upon receiving the acceptance of participation, the session partner selecting server 200 notifies the electronic music devices A-D of counterparts IP addresses and communication ports (step S204). Specifically, the session partner selecting server 200 notifies the electronic music device A of the IP addresses and communication ports of the electronic music devices B-D while notifying the electronic music devices B-D of the IP address and communication port of the electronic music device A.

Upon receiving the IP addresses and communication ports of the electronic music devices B-D by way of the session partner selecting server 200, the electronic music device A stores the IP addresses and communication ports in a predetermined area of the RAM 8; subsequently, the electronic music device A is placed in a net-session standby state (step S104). In the net-session standby mode, the electronic music device A is ready for starting a net-session with the electronic music devices B-D at any time since the received IP addresses and communication ports are set to the communication interface 10. The other electronic music devices B-D perform the same operation as the electronic music device A (step S304).

Next, the electronic music device A displays a performance operator screen on the touch panel display 2 (step S105). The performance operator screen currently displayed is created based on the currently selected block and its layer. FIG. 2A shows an example of the performance operator screen 2*a*. The step S105 (corresponding to the step S306 which will be discussed later) is written in a dashed block because it can be omitted from the control process. This is because performance operators are not necessarily depicted using virtual images but can be configured of physical operators. When the performance operators are configured of physical operators instead of virtual images displayed on the screen, the step S105 is no longer necessary in the control process.

When the user of the electronic music device A touches a "net-session start" button in the performance operator screen, the electronic music device A performs an initialization process and a tone-generation timing synchronization process (step S106). The initialization process includes a clear process for clearing all tone-generation points, a reset process for resetting the position of a loop indicator, a reset/start process for resetting/starting a timer (which is installed in the CPU 6), and another clear process for clearing the stored content of the RAM 8.

In general, a communication delay (or a delay time) occurring between counterpart electronic music devices varies depending on the types of devices. A communication delay occurring between the devices of the same type, e.g. between the electronic music devices A and B, may normally vary and fluctuate due to various factors. The timers installed in the electronic music devices A-D may cause time deviations due to differences of resetting/setting timings thereof or due to differences of accuracies thereof even when they are reset/set at the same timing However, it can be said that a delay time of a transmission path may be approximately identical to a delay time of a reception path in one reciprocating communication, wherein a difference between delay times may be negligible. For this reason, the present embodiment adjusts the tone-generation timing based on the presumption that the delay time of a transmission path is identical to the delay time of a reception path in one reciprocating communication.

Figure 7:
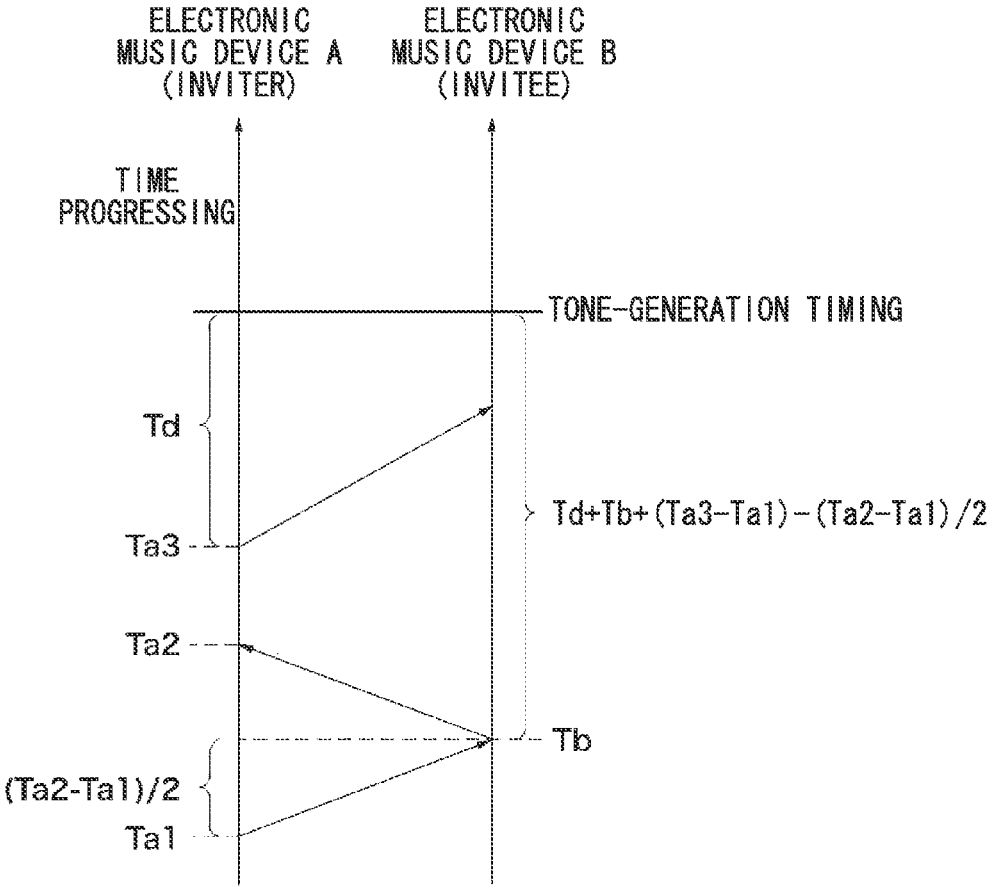
FIG. 7 is a time chart illustrating a tone-generation timing synchronization method.

FIG. 7 is a time chart illustrating a tone-generation timing synchronization method. The tone-generation timing synchronization process will be described with reference to FIG. 7. The electronic music device A performs the tone-generation timing synchronization process in conjunction with all the electronic music devices B-D, wherein the same processing applied to all the electronic music devices B-D; hence, the following description solely refers to the tone-generation timing synchronization process conducted between the electronic music devices A and B.

First, the electronic music device A sends a present time request command to the electronic music device B. In FIG. 7, Ta1 indicates the transmission time of the present time request command, which is stored in a time memory area (not shown) which is secured at a predetermined memory position of the RAM 8 of the electronic music device A. Upon receiving the present time request command, the electronic music device B sends back a present time (i.e. Tb), which is measured using a timer function thereof, to the electronic music device A. Herein, the time Tb may be set to the reception time of the present time request command or the transmission time for sending back the present time to the electronic music device A. If the CPU of the electronic music device B has a high processing speed, it is possible to assume that the reception time is approximately identical to the transmission time. Upon receiving the present time Tb of the electronic music device B, the electronic music device A measures a reception time of the present time Tb by way of a timer function thereof. In FIG. 7, Ta2 indicates the reception time of the present time Tb, which is stored in the time memory area of the RAM 8 of the electronic music device A. Additionally, the electronic music device A stores the present time Tb in the time memory area of the RAM 8. Based on the times Ta1 and Ta2 stored in the time memory area of the RAM 8, the electronic music device A calculates a one-way delay time (e.g. several tens of milliseconds) as follows.

$$\text{One-way delay time}=(Ta2-Ta1)/2$$

A time Ta3 is arbitrarily determined to follow the time Ta2. The electronic music device A determines to adjust the tone-generation timing at a certain time, i.e. a predetermined time Td elapsed after the time Ta3; hence, the electronic music device A actually establishes the tone-generation timing (i.e. the setting of a reference time for automatic performance) at this time. Herein, the predetermined time Td is longer than the one-way delay time. The electronic musical device A sends a tone-generation timing command that instructs the electronic music device B to establish the tone-generation timing at the designated time (a) or (b) as follows.

$$Td+Tb+(Ta3-Ta1)-(Ta2-Ta1)/2 \quad \text{(a)}$$

$$Td+Tb+(Ta3-Ta2)+(Ta2-Ta1)/2 \quad \text{(b)}$$

Upon receiving the tone-generation timing command, the electronic music device B automatically establishes the tone-generation timing (i.e. the setting of a reference time for automatic performance) at the designated time (a) or (b).

The present embodiment is characterized in that the factor for determining the tone-generation timing is limited to a communication delay which occurs when measuring the one-way delay time. Additionally, the reference time (or start time) for determining the tone-generation timing is shared between the electronic musical devices A and B such that the time of Ta1+(Ta2−Ta1)/2 counted by the electronic music device A matches the time Tb counted by the electronic music device B. This provides the precise matching of the tone-generation timing between the electronic music devices A and B even when a communication delay involving the tone-generation timing differs from a communication delay involving the time of measuring the one-way delay time.

Referring back to FIG. 4, the electronic music device A executes a net-session process (step S107). In the net-session process, various pieces of operational information, representing manual operations that the user applies to the electronic music device A, are transmitted to the other electronic music devices B-D, thus achieving a net-session between the electronic music device A and the other electronic music devices B-D. On the other hand, various pieces of operational information, representing manual operations that the users apply to the electronic music devices B-D, are transmitted to the electronic music device A. That is, various pieces of operational information are transferred bi-directionally between the electronic music device A and the other electronic music devices B-D; hence, the other electronic music devices B-D execute a net-session process (step S307).

The net-session process is repeatedly executed until the user declares an end of processing regarding the net-session process, so that a series of steps S107 and S108 is repeated before step S109. When the user declares an end of processing, the electronic music device A proceeds to an end of processing (step S109) and then exits the control process. An end of processing includes a logoff process made by the session partner selecting server 200. Details of the logoff process are not described in this specification. In this connection, the other electronic music devices B-D execute a series of steps S308, and S309 similar to the foregoing steps S07, S108, and S109 executed by the electronic music device A.

Figure 5:
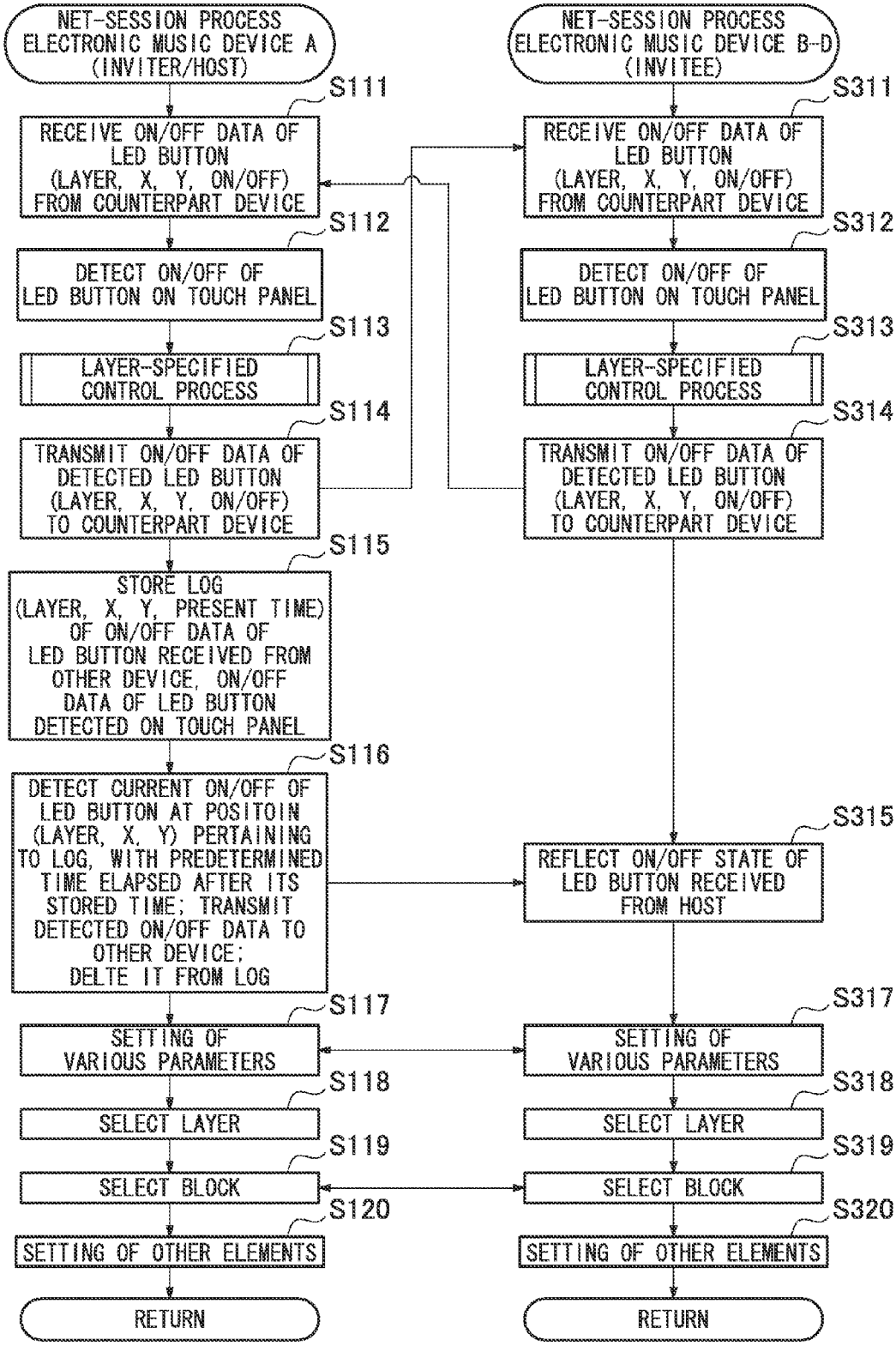
FIG. 5 is a flowchart showing detailed procedures of steps S107 and S307 shown in FIG. 4.

FIG. 5 is a flowchart showing detailed procedures of the foregoing steps S107 and S307 in the net-session processes executed by the electronic music device A and the other electronic music devices B-D.

First, the electronic music device A receives on/off data of LED buttons from the other electronic music devices B-D, wherein the received on/off data of LED buttons are stored in an on/off data memory area (not shown) which is secured at a predetermined memory position of the RAM 8 (step S111). On/off data of each LED button is configured of a format (Layer,X,Y,ON/OFF), wherein "Layer" denotes the number of a layer used for displaying each LED button (i.e. a value selected from among "01" to "16"); "X" denotes a horizontal coordinate of each LED button (i.e. a value selected from among "01" to "16"); and "Y" denotes a vertical coordinate of each LED button (i.e. a value selected from among "01" to "16"); and "ON/OFF" denotes an on/off state of each LED button. In this connection, the received on/off data of each LED button is stored in the on/off data memory area together with its reception time. The reception time of the on/off data is used to discriminate either a short press or a long press with respect to each LED button. Even when the flow proceeds to step S111, there is a possibility that the other electronic music devices B-D do not transmit on/off data of LED buttons to the electronic music device A. In this case, the electronic music device A may skip the step S111 so that the flow proceeds to the next step S112. Such a skip-and-proceed operation can be applied to steps S112 to S120 except for step S113.

Next, the electronic music device A detects an on/off operation applied to each LED button on the touch panel display 2, generates on/off operation information based on the detected on/off state of each LED button, and then stores the on/off operation information in an on/off operation information memory area (not shown) which is secured at a predetermined memory position of the RAM 8 (step S112). Herein, the on/off operation information is configured of a format (X,Y,ON/OFF,T), i.e. the format of on/off data precluding "Layer" and adding an on/off operation time "T" of making an on/off operation on each LED button. The format of the on/off operation information does not necessarily preclude "Layer"; hence, this format can be created by simply adding the on/off operation time T to the format of on/off data.

Figure 6:
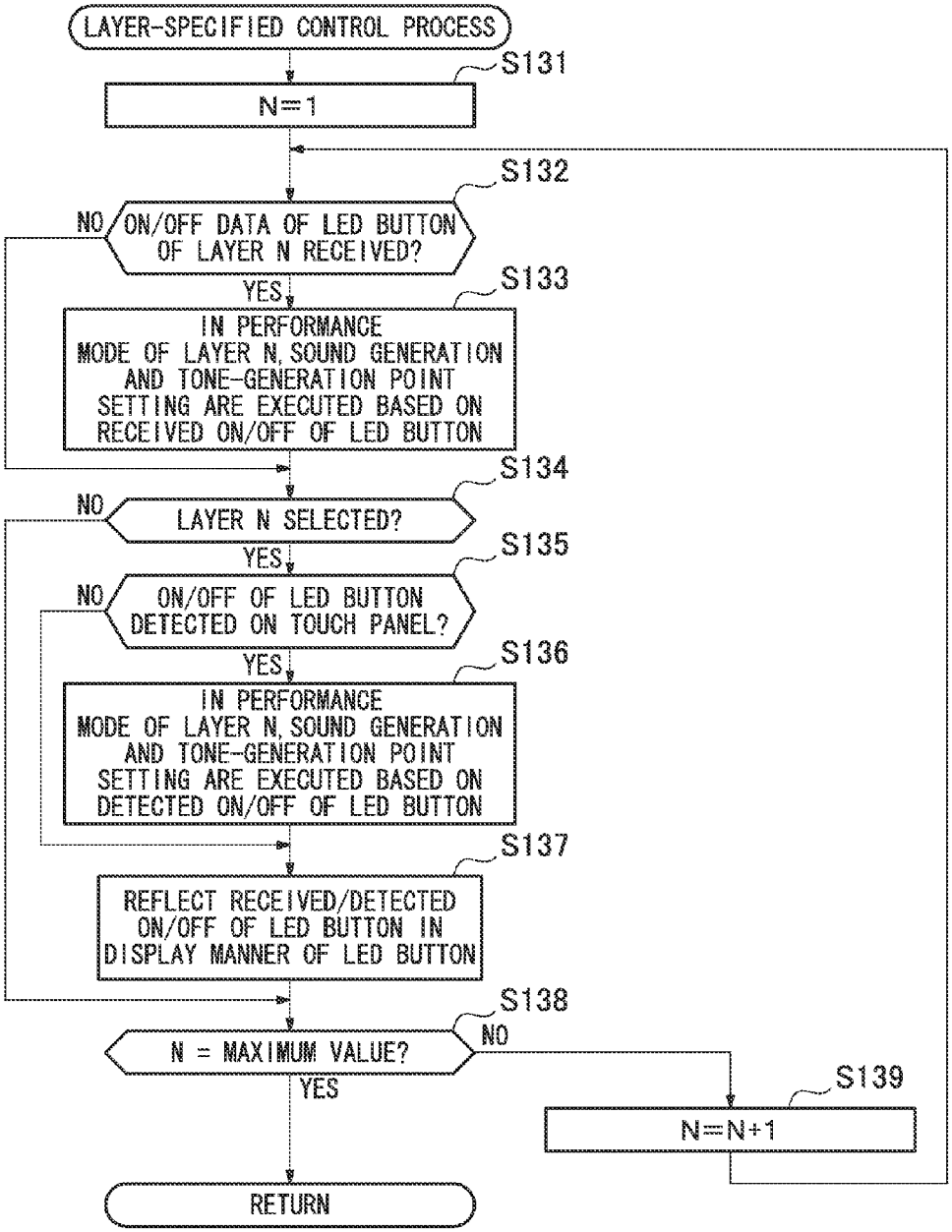
FIG. 6 is a flowchart of a layer-specified control process executed by each electronic music device.

Next, the electronic music device A carries out a layer-specified control process (step 113). FIG. 6 shows a detailed procedure of the layer-specified control process. The layer-specified control process of FIG. 6 includes the following steps.

(11) Step S131: An initial value "1" is set to an integer-type variable N.

(12) Step S132: A decision is made as to whether or not the performance operator screen displayed by any one of the electronic music devices B-D is created based on Layer N and an on/off operation is applied to any one of LED buttons in the performance operator screen.

(12a) Step S133: When the decision result of step S132 is "YES", a first reflection process is carried out to reflect the on/off operation in the sound generation and the tone-generation point setting with the electronic music device A.

(12b) When the decision result of step S132 is "NO", the first reflection process is skipped in the layer-specified control process.

(13) Step S134: A decision is made as to whether or not the electronic music device A selects Layer N, in other words, a decision is made as to whether or not the performance operator screen displayed on the touch panel display 2 is created based on Layer N.

(13a) Proceeds to (14) when the decision result of step S134 is "YES".

(13b) Proceed to (16) when the decision result of step S134 is "NO".

(14) Step S135: A decision is made as to whether or not an on/off operation is applied to any one of LED buttons in the performance operator screen displayed on the touch panel display 2.

(14a) Step S136: When the decision result of step S135 is "YES", a second reflection process is carried out to reflect the on/off operation in the sound generation and the tone-generation point setting with the electronic music device A.

(14b) When the decision result of step S135 is "NO", the second reflection process is skipped in the layer-specified control process.

(15) Step S137: A third reflection process is performed to reflect the on/off operation applied to any one of the electronic music devices B-D (see (2a), step S133) and the on/off operation applied to the electronic music device A (see (4a), step S136) in the display manners of LED buttons displayed in the performance operation screen of the touch panel display 2 based on Layer N.

(16) Step S138: A decision is made as to whether or not the variable N reaches the maximum value, i.e. the number of layers included in the currently selected block.

(16a) When the decision result of step S138 is "YES", the electronic music device A exits the layer-specified control process.

(16b) Step S139: When the decision result of step S138 is "NO", the variable N is incremented by "1", so that the layer-specified control process proceeds to the next layer. Herein, the flow returns to step S132 (see (12)) so as to repeat a series of operations (12) through (16).

Specifically, the step S132 (see (12)) firstly refers to a decision as to whether or not one on/off data of at least one LED button is stored in the on/off data memory area; and then, when it is confirmed that on/off data of at least one LED button is stored in the on/off data memory area, a decision is made as to whether or not the on/off data is related to Layer N. The situation in which on/off data of any LED button is stored in the on/off data memory area is regarded as the situation in which the user handling any one of the other electronic music devices B-D applies an on/off operation to any one of LED buttons displayed in the performance operator screen based on the currently selected layer (i.e. the layer which has been selected when on/off data is created). The number of the currently selected layer can be recognized by checking the layer number included in on/off data.

In the first reflection process (see (12a)), the electronic music device A executes a sound generation process and a tone-generation point setting process based on the received on/off data of a certain LED button in response to the performance mode currently set to Layer N (step S133). Herein, the electronic music device A executes the same sound generation process and the same tone-generation point setting process as the foregoing sound generation process and the tone-generation point setting process, which are executed in the second reflection process (see (14a)), based on on/off data of a certain LED button which is transmitted from any one of the other electronic music devices B-D when the user gives a short press or a long press to any one of LED buttons in the performance operator screen on the touch panel display 2 of the electronic music device A. For this reason, it is necessary to make a decision, prior to the first reflection process or during execution of the first reflection process, as to whether the received on/off data corresponds to a short press or a long press. Herein, the received on/off data is configured of the format (N,X1,Y1,ON/OFF). Since all the on/off data are accompanied with their reception times, it is possible to discriminate whether on/off data corresponds to a short press or a long press based on its reception time in accordance with the following procedure.

First, a time interval I (=t2−t1) is calculated between a reception time t1 of (N,X1,Y1,ON) and a reception time t2 of (N,X1,Y1,OFF). It is possible to determine a short press when the time interval I is less than the predetermined threshold $I_H$ (where $I<I_H$) or a long press when the time interval I is equal to or longer than the predetermined threshold $I_H$ (where $I \geqq I_H$). Based on the discrimination result as to whether on/off data corresponds to a short press or a long press, it is possible to univocally determine the processing regarding the sound generation process and the tone-generation point setting process in response to the performance mode of Layer N, thus enabling the electronic music device A to execute the processing.

When on/off data is discriminated as a short press while the score mode is set to the performance mode of Layer N, for example, a sound having a pitch assigned to the LED button disposed at the coordinates (X1,Y1) is generated with a tone color set to Layer N in accordance with the sound generation process. Herein, the tone-generation point setting process is not executed because the short press does not necessarily involve the tone-generation point setting. On the other hand, when on/off data is discriminated as a long press in the score mode, the sound generation process is not carried out so that a sound having a pitch assigned to the LED button is not generated. Herein, the tone-generation point setting process is carried out to set a tone-generation point to the LED at the coordinates (X1,Y1) in Layer N.

In step S135 (see (14)), a decision is made as to whether or not at least one on/off operation information regarding at least one LED button is actually stored in the on/off operation information memory area. At least one on/off operation information regarding at least one LED button is stored in the on/off operation information memory area only when the user conducts an on/off operation on at least one LED buttons in the performance operator screen which is displayed on the touch panel display 2 based on the currently selected layer. The decision (14) is made when the currently selected layer is regarded as Layer N. Based on the fact that at least one on/off operation information has been stored in the on/off operation information memory area at the time of making the decision (14), it is possible to presume that the on/off operation information has been created and stored by the user who conducts an on/off operation on any one of LED buttons on the touch panel display 2.

In the second reflection process (see (14a)), the electronic music device A execute a sound generation process and a tone-generation point setting process based on the detected on/off operation information regarding each LED button (i.e. the on/off operation information stored in the on/off operation information memory area) in response to the performance mode currently set to Layer N (step S136). The on/off operation information employed in the second reflection process differs from the on/off data employed in the first reflection process in that the on/off operation information does not include the layer number but includes the on/off operation time. For this reason, the second reflection process can be easily implemented by presumably applying the foregoing operation of the first reflection process; hence, details of the second reflection process will not be described.

In the third reflection process (see (15)), a received/detected on/off operation applied to a certain LED button is reflected in the display manner of the corresponding LED button in the performance operator screen on the touch panel display 2. The reason why the third reflection process is not included in the first reflection process but executed independently will be described below.

Suppose the situation where Layer N is selected by any one of the electronic music devices B-D (e.g. the electronic music device B) but is not selected by the electronic music device A. In this situation, when the user gives a short press to a certain LED button of the electronic music device B, a sound with a pitch assigned to the LED button in Layer N is generated whilst the display manner of the corresponding LED button in the performance operator screen is not changed because the performance operator screen is displayed based on another layer different from Layer N.

Referring back to FIG. 5, the electronic music device A sends the detected on/off data of a certain LED button to the other electronic music devices B-D (step S114). Upon detecting an on/off operation of each LED button, its on/off operation information in the format (X,Y,ON/OFF,T) is stored in the on/off operation information memory area. In step S114, the electronic music device A converts this format into the format (Layer,X,Y,ON/OFF) used for on/off data, thus sending the on/off operation information of the converted format to the other electronic music devices B-D. Herein, the number of the layer currently selected by the electronic music device A is applied to "Layer" in the converted format. If the on/off operation information employs the format including "Layer", it is necessary to preclude "T" from the format (Layer,X,Y, ON/OFF,T).

Next, the electronic music device A executes the tone-generation point synchronization process in steps S115, S116 (see (12)).

Figure 8:
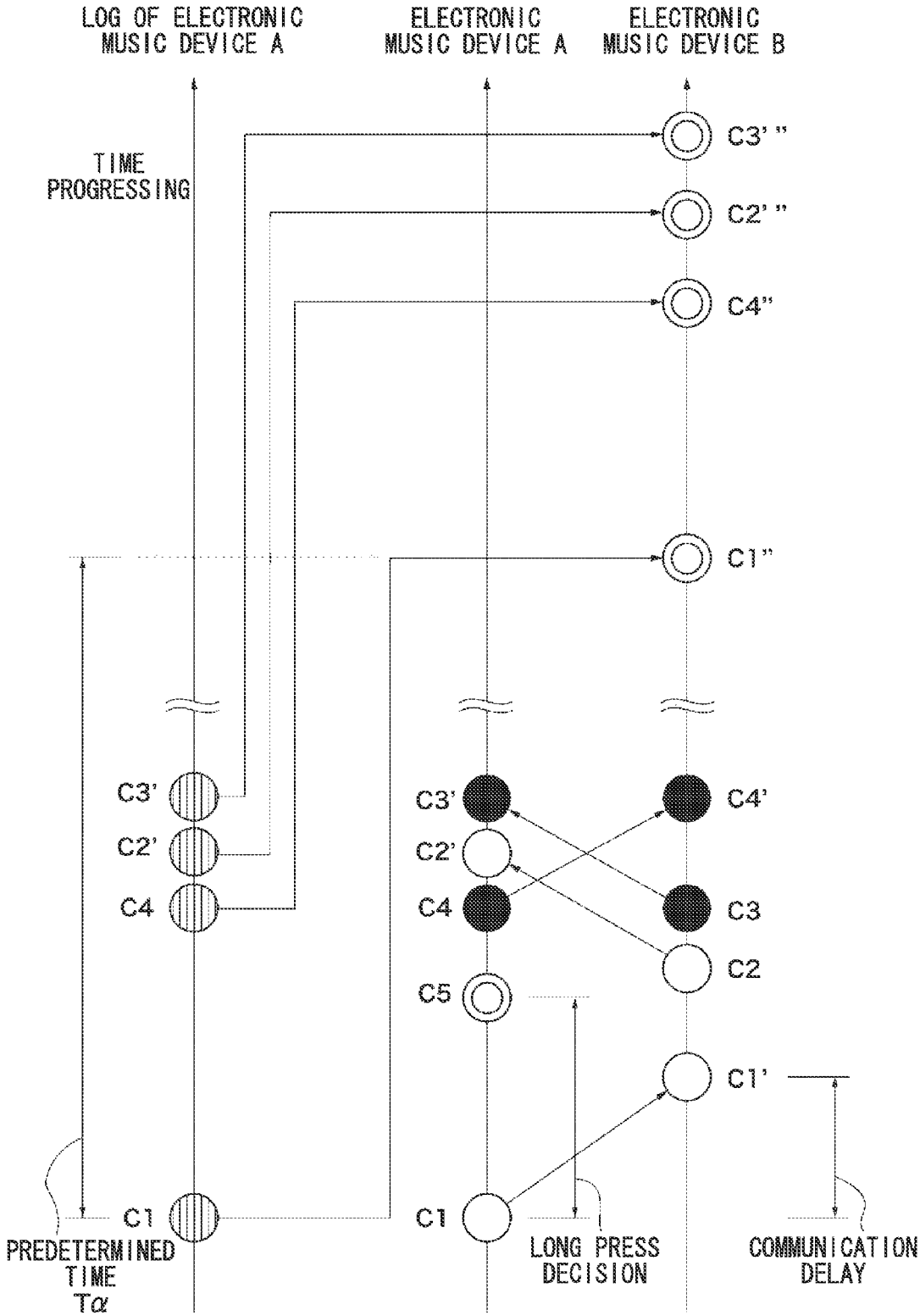
FIG. 8 is a time chart illustrating the tone-generation point synchronization process.

FIG. 8 is a time chart illustrating the tone-generation point synchronization process. FIG. 8 refers to the situation in which the same layer is selected by the electronic music device A and the electronic music device B (which is the representative selected from the other electronic music device B-D; hence, it is possible to select the electronic music device C or D instead of the electronic music device B). In this situation, when the users of the electronic music devices A, B simultaneously change their tone-generation point on/off states with respect to the same LED button displayed in the same performance operator screen based on the same layer, the electronic music devices A, B differ from each other in terms of tone-generation point on/off states.

In FIG. 8, State C1 indicates that a certain LED button is turned on in the electronic music device A, and State C1' indicates that State C1 reaches the electronic music device B after a lapse of a communication delay time (e.g. several tens of milliseconds). Actually, State C1 does not reach the electronic music device B, but on/off data of a certain LED button forwarded from the electronic music device A reaches the electronic music device B. For the sake of simplifying the explanation, the following description employs the expression in which State Ck (where k is an integer) is sent or received between the electronic music devices A, B. After State C1, the user holds the LED button for a long time which is longer than the predetermined threshold (i.e. a long-press determination time), so that a tone-generation point is set to the LED button in State C5 (see a double-circular mark indicating the setting state of a tone-generation point in FIG. 8).

At the time of State C1', the electronic music device B proceeds to a decision as to whether the LED button is subject to a short press or a long press. During execution of this decision, the LED button is sequentially turned on and off (see States C2, C3) within a short time less than the long-press determination time. In this case, States C2, C3 from the electronic music device B reach the electronic music device A after a lapse of a communication delay time (see States C2', C3'). If the time interval between States C1' and C2 is less than the long-press determination time, the electronic music device B does not set a tone-generation point to the LED button.

When the user of the electronic music device A turns off the LED button (see State C4) before State C2' (corresponding to State C2 indicating that the user of the electronic music device B turns on the LED button), State C4 reaches the electronic music device B after a lapse of a communication delay time (see State C4').

When an on operation and an off operation occurs on the same LED button concurrently in a plurality of electronic music devices, different tone-generation points setting states may be applied to the same LED button. FIG. 8 shows that the electronic music device A sets a tone-generation point to the LED button whilst the electronic music device B does not set a tone-generation point to the LED button.

To cope with this drawback, the present embodiment selects one electronic music device (e.g. the electronic music device A) acting as a host from among a plurality of electronic music devices (i.e. the electronic music devices A-D) conducting a net-session. When any one of the users of the electronic music devices A-D conducts an on/off operation on one of LED buttons displayed in the performance operator screen of the "host" electronic music device A, a log regarding the on/off operation of the LED button (e.g. a format (Layer,X,Y, present time)) is stored in a log memory area (not shown) which is secured at a predetermined memory position of the RAM 8 (step S115). If a predetermined time (e.g. one second) has elapsed from the stored time of the log, the electronic music device A checks the current on/off state with respect to the LED button at the coordinates (Layer,X,Y) so as to send the on/off state to the other electronic music devices B-D, and then erases the log (step S116).

Specifically, when a predetermined time Tα (which is arbitrarily set in advance) has elapsed from the stored time of the log of State C1 in FIG. 8, the electronic music device A checks the current on/off state of the LED button. Since the tone-generation point has been set to the LED button, the electronic music device A sends information, indicating that the tone-generation point is set to the LED button, to the electronic music device B (see State C"). The electronic music device B reflects State C" on the corresponding LED button thereof (step S315). Thus, the on/off state of the LED button of the electronic music device A matches with the on/off state of the corresponding LED button of the electronic music device B. Similarly, the electronic music device A checks the current on/off state of the LED button when the predetermined time Tα has elapsed from the stored times of the logs of States C4, C2', C3', thus sending the on/off state to the electronic music device B (see States C4", C2'", C3'"). In actuality, however, it is unnecessary to inform the electronic music device B of the current on/off state because the same on/off state (indicating that the tone-generation point is set to the LED button) has been maintained. In this case, the electronic music device A needs to send State C1 to the electronic music device B as State C1"; thereafter, the electronic music device A does not necessarily send States C4, C2', C3' to the electronic music device B as States C4", C2'", C3'".

As described above, the present embodiment is designed to record a log when the user conducts an on/off operation on an LED button of the "host" electronic music device, wherein the on/off state of the LED button indicated by the log is sent to the other electronic music devices, each of which reflects the received on/off state on the corresponding LED button. Except for a slight time lag, the present embodiment is able to set the same on/off state of a certain LED button among all the electronic music devices (including the "host" electronic music device).

In the present embodiment, the electronic music device A acts as both the host and the inviter, but this is not a restriction; hence, it is possible to provide one electronic music device acting as a host, and another electronic music device acting as an inviter.

Referring back to FIG. 5, when the user sets various parameters with the electronic music device A, the electronic music device A sends the setting content thereof to the other electronic music devices B-D. On the other hand, when the other user sets various parameters with any one of the other electronic music devices B-D, the other electronic music device sends the setting content thereof to the electronic music device A; hence, the electronic music device A reflects the received setting content on various parameters thereof (step S117). When the electronic music device A changes the currently selected block with another block, the electronic music device A sends the number of another block to the other electronic music devices B-D. On the other hand, when one of the other electronic music devices B-D changes the currently selected block with another block, the other electronic music device sends the number of another block to the electronic music device A; hence, the electronic music device A receive and reflects the changed number to select another block therein (step S119). Thus, all the electronic music devices involved in a net-session are able to conduct music performance based on the same block. In contrast to blocks, a change of layers is reflected solely in the electronic music device A and is not sent to the other electronic music devices B-D (step S118). This is because the present embodiment allows the electronic music devices A-D to play music performance based on respective layers. Similar to the setting of layers, even when the electronic music device A makes other settings, those setting contents are not sent to the other electronic music devices B-D (step S120).

As described above, the electronic music device A carries out its net-session process. The other electronic music devices B-D carries out their net-session processes similar to the net-session process of the electronic music device A, wherein steps S311 to S314 are equivalent to steps S111 to S114, and steps S317 to S320 are equivalent to steps S117 to S120. In this connection, steps S311-S314 and steps S317-S320 involving the other electronic music devices B-D are not described in detail since they can be easily implemented by presumably applying steps S111-S114 and S117-S120 involving the electronic music device A.

The present embodiment carries out the tone-generation timing synchronization process (see (1)) only once before starting a net-session, whereas it is possible to carry out the tone-generation timing at arbitrary timing during execution of a net-session.

The present embodiment is designed using the electronic music devices A-D each furnished with a net-session ability. Although the present embodiment does not explicitly refer to an ability to play sole performance, the present embodiment can be reconfigured to adopt the electronic music devices A-D additionally furnished with an ability to play sole performance.

In the present embodiment, all the tone-generation points set to the selected layer have been cleared by the initialization (see steps S106, S306 in FIG. 4) before starting a net-session so that music performance is started from the clear condition; this is not a restriction. For instance, predetermined song data (which consists of a plurality of blocks each consisting of a plurality of layers) can be distributed to the electronic music devices A-D, allowing the electronic music devices A-D to play a net-session by reproducing song data. Additionally, performance data, which are created during a net-session, can be stored in memory as song data.

The tone-generation timing synchronization process and the tone-generation point synchronization process (see (1), (2)) are not necessarily applied to "matrix sequencers", e.g. the electronic music devices A-D each equipped with a matrix arrangement of LED buttons allowing users to enjoy sound and light emission (or display). These processes can be easily applied to other types of music systems enabling synchronized performance with a plurality of electronic music devices.

The matrix sequencer is not necessarily designed such that a plurality of layers can be simultaneously reproduced while a plurality of blocks each consisting of a plurality of layers can be switched over and reproduced. That is, the matrix sequencer does not necessarily involve the layered concept so as to reproduce a single layer, or the matrix sequencer furnished with an ability of simultaneously reproducing a plurality of layers does not necessarily involve the blocked concept so as to reproduce a single block.

In the present embodiment, the electronic music devices A-D are each designed to accept manual operations of performance operators including LED buttons and drive the sound source/effect circuit 11 (particularly, the sound source circuit) to produce designated sounds every time the loop indicator overlaps with tone-generation timings; but this is not a restriction. For instance, the present embodiment can be modified to read audio waveform data, which are prepared in advance, and thereby generate sounds based on audio waveform data. The present embodiment is designed based on the precondition that the sound source circuit is configured of hardware; but this is not a restriction. For instance, it is possible to provide a software sound source which produces music sound waveforms by use of the CPU 6. Moreover, the present embodiment is not necessarily equipped with the sound source/effect circuit 11, which can be precluded from the electronic music device. In this case, the electronic music device is redesigned to send sound generation/muting commands to an external sound source device, which are thus controlled to generate sounds.

In the tone-generation point synchronization process (see (2)), one electronic music device (selected from a plurality of electronic music devices) is assigned with a function of managing logs and a function of sending a synchronization instruction (e.g. an inconsistency eliminating instruction) to other electronic music devices; but this is not a restriction. For instance, a certain device not involved in music performance can be assigned with a function of receiving operation data from electronic music devices and recording their logs and a function of sending an inconsistency eliminating instruction to electronic music devices.

In the present embodiment, logs representing manual operations of LED buttons are cast into the format (Layer,X, Y, present time) so as to record layers, coordinates of LED buttons, and timings, and then the latest on/off states of LED buttons at designated coordinates in the currently selected layer are sent to other electronic music devices; but this is not a restriction. For instance, logs are recorded with respect to on/off states of LED buttons so that the recorded on/off states instead of the latest on/off states can be sent to other electronic music devices.

In the present embodiment, the electronic music device changes the display manners of LED buttons based on on/off data of the corresponding LED buttons received from other electronic music devices only when the layer number included in the received on/off data matches with the currently selected layer number; but this is not a restriction. The electronic music device can be modified to change the display manners of LED buttons in conformity with the corresponding LED buttons of the other electronic music devices even when the layer number included in the received on/off data does not match with the currently selected layer number. However, the user may be confused by complex displayed images when the electronic music device is allowed to change the display manners of LED buttons assigned with tone-generation points over a plurality of layers, wherein it is difficult to recognize which layer is currently selected and displayed on the screen. For this reason, it is preferable that the display manner regarding the currently selected layer differ from the displayed manner regarding the unselected layer. For instance, only the LED buttons involving real-time performance and sound generation can be changed in their display manner; LED buttons regarding the unselected layer are reduced in brightness; and LED buttons involving tone-generation point setting are unchanged in their display manner.

Additionally, the display manner of LED buttons based on manual operations of one electronic music device may differ from the display manner of LED buttons base on on/off data received from other electronic music devices. It is possible to include device IDs in on/off data so as to discriminate electronic music devices sending on/off data of LED buttons. In this case, the electronic music device receiving on/off data may change display manners of LED buttons (using different colors) depending on device IDs. Herein, the sender side of the electronic music device sending on/off data of LED buttons may designate display manners depending on its device ID. Alternatively, the receiver side of the electronic music device receiving on/off data of LED buttons may designate display manners depending on its device ID. When the sender side designates display manners depending on its device ID, the sender side should send its display manner setting information to the receiver side.

In the present embodiment, one of the electronic music devices, which firstly issues an invitation to a net-session, is designated as an "inviter" while the other electronic music devices are each designated as an "invitee", wherein each electronic music device should be defined as either an inviter or an invitee; but this is not a restriction. For instance, each electronic music device can be defined as either an inviter or an invitee only when a certain electronic music device designates its session partner. Alternatively, each electronic music device is not necessarily discriminated as an inviter or an invitee when the session partner selecting server 200 automatically selects a session partner, so that all the electronic musical devices can act as an inviter.

In the present embodiment, on/off data of each LED button is cast into the format (Layer,X,Y,ON/OFF) so that the receiver side of the electronic music device receiving on/off data makes a decision as to whether on/off data corresponds to a short press or a long press; but this is not a restriction. The sender side of the electronic music device sending on/off data may make a decision as to whether on/off data corresponds to a short press or a long press, wherein the sender side may include "press state information", representing the result of the decision as to whether on/off data corresponds to a short press or a long press, in on/off data. In this case, the receiver side of the electronic music device receiving on/off data examines the press state information included in the received on/off data, thus discriminating whether the received on/off data corresponds to a short press or a long press.

The foregoing functions of the present embodiment are not necessarily implemented by electronic music devices configured of hardware and software. That is, it is possible to implement the foregoing functions of the present embodiment by way of software, so that its program codes can be stored in recording media installed in system or apparatus. Thus, the entire functionality of the present embodiment can be implemented by the computer of the system or apparatus (e.g. CPU or MPU) which loads and executes program codes stored in recording media.

In the above, program codes read from recording media realize the brand-new functionality of the present embodiment; hence, program codes or recording media storing program codes implement the functionality of the present embodiment.

As recording media providing program codes, for example, it is possible to employ flexible disks, hard disks, magneto-optic disks, CD-ROM, CD-R, CD-RW, DVD-ROM, DVD-RAM, DRV-RW, DVD+RW, magnetic tapes, nonvolatile memory cards, and ROM. Alternatively, it is possible to provide program codes from a server computer via a communication network.

The foregoing functionality of the present embodiment is not necessarily achieved by simply executing program codes loaded into a computer. Alternatively, the operating system (OS) of the computer can carry out a part or the entirety of processing based on instructions of program codes, thus implementing the foregoing functionality of the present embodiment.

It is possible to load program codes of recording media into a memory installed in a function-extending board inserted into a computer or a function-extending unit coupled with a computer. In this case, a CPU installed in a function-extending board or a function-extending unit can carry out a part of or the entirety of processing based on instructions of program codes, thus implementing the functionality of the present embodiment.

As described heretofore, the present invention is not necessarily limited to the foregoing embodiment and its variations; hence, the present invention may embrace any modifications and design choices that fall within the scope of the invention as defined by the appended claims.

What is claimed is:

1. A tone-generation timing synchronization method for synchronizing timing between first and second electronic music devices each including an interface connectible to a communication network, the tone-generation timing synchronization method comprising the steps of:

communicating between the first and second electronic music devices via the communication network so that the first electronic music device sends an inquiry at a time Ta1 counted by the first electronic music device to the second electronic music device about a present time Tb counted by the second electronic music device;

communicating between the first and the second electronic music device so that the second electronic music device sends the present time Tb to the first electronic music device, wherein the present time Tb indicates the time when the second electronic music device receives or responds to the inquiry sent by the first electronic music device;

measuring with the first electronic music device, a time Ta2 at which the first electronic music device receives the present time Tb from the second music device;

setting with the first electronic music device, a time Ta3 that progresses from the time Ta2 in the first electronic music device;

further setting with the first electronic music device, a time interval Td counted from the time Ta3 by the first electronic music device; and determining with the first electronic music device tone-generation timing, shared between the first electronic music device and the second electronic music device, at which the first electronic music device is synchronized with the second electronic music device in conducting an online real-time session therebetween based on:

$$Td+Tb+(Ta3-Ta1)-(Ta2-Ta1)/2, \text{ or}$$

$$Td+Tb+(Ta3-Ta2)+(Ta2-Ta1)/2.$$

2. An electronic music device comprising:

an interface that establishes a connection with a counterpart electronic music device; and a controller that:

conducts an online real-time session with the counterpart electronic music device;

sends an inquiry at a time Ta1 to the counterpart electronic music device about a present time Tb counted by the counterpart electronic music device;

receives the present time Tb from the counterpart electronic music device, the present time Tb indicating the time when the counterpart electronic music device receives or responds to the inquiry;

measures a time Ta2 at which the present time Tb is received from the counterpart electronic music device;

sets a time Ta3 that progresses from the time Ta2;

further sets a time interval Td counted from the time Ta3; and determines tone-generation timing at which the electronic music device is synchronized with the counterpart electronic music device in conducting an online real-time session based on:

$$Td+Tb+(Ta3-Ta1)-(Ta2-Ta1)/2, \text{ or}$$

$$Td+Tb+(Ta3-Ta2)+(Ta2-Ta1)/2.$$

* * * * *

UNITED STATES PATENT AND TRADEMARK OFFICE

CERTIFICATE OF CORRECTION

PATENT NO. : 8,461,444 B2
APPLICATION NO. : 13/334736
DATED : June 11, 2013
INVENTOR(S) : Akihiro Miwa It is certified that error appears in the above-identified patent and that said Letters Patent is hereby corrected as shown below:

The Title Page; below Abstract; should be corrected to read --3 Claims, 8 Drawing Sheets--

In the Claims:

Column 22, line 57, Insert the following:

--3. A non-transitory computer-readable storage medium storing a program executable by a first electronic music device to execute a method of implementing a tone-generation timing synchronization method for controlling an online real-time session with a second electronic music device, each of the first and second electronic music device including an interface connectible to a communication network, the tone-generation timing synchronization method comprising the steps of:

communicating between the first and second electronic music devices via the communication network so that the first electronic music device sends an inquiry at a time Ta1 counted by the first electronic music device to the second electronic music device about a present time Tb counted by the second electronic music device;

communicating between the first and the second electronic music device so that the second electronic music device sends the present time Tb to the first electronic music device, wherein the present time Tb indicates the time when the second electronic music device receives or responds to the inquiry sent by the first electronic music device;

measuring with the first electronic music device, a time Ta2 at which the first electronic music device receives the present time Tb from the second music device;

setting with the first electronic music device, a time Ta3 that progresses from the time Ta2 in the first electronic music device;

further setting with the first electronic music device, a time interval Td counted from the time Ta3 by the first electronic music device; and determining with the first electronic music device tone-generation timing, shared between the first electronic music device and the second electronic music device, at which the first electronic music device is synchronized with the second electronic music device in conducting an online real-time session therebetween based on:

Signed and Sealed this
Third Day of September, 2013

Teresa Stanek Rea

Teresa Stanek Rea
*Acting Director of the United States Patent and Trademark Office*

Td + Tb + (Ta3 - Ta1) - (Ta2 - Ta1)/2, or
Td + Tb + (Ta3 - Ta2) + (Ta2 - Ta1)/2.--